US005226864A

United States Patent [19]

Showers

[11] Patent Number: 5,226,864

[45] Date of Patent: Jul. 13, 1993

[54] PLAYGROUND MAZE APPARATUS

[75] Inventor: David F. Showers, Malvern, Australia

[73] Assignee: Glenwood Systems Pty. Ltd., Australia

[21] Appl. No.: 787,398

[22] Filed: Nov. 4, 1991

[51] Int. Cl.[5] ..... A63B 9/00; A63B 17/00

[52] U.S. Cl. ..... 482/35; 482/148

[58] Field of Search ..... 482/35, 148, 36; 472/136, 137; 119/29

[56] References Cited

U.S. PATENT DOCUMENTS

| | | | |
|---|---|---|---|
| D. 218,460 | 8/1970 | Dattner . | |
| D. 218,765 | 9/1970 | Dattner | 482/35 |
| D. 250,784 | 1/1979 | Dieter . | |
| 548,796 | 10/1895 | Bayuk . | |
| 572,142 | 12/1896 | Williams | 482/35 |
| 2,883,192 | 4/1959 | Royston | 482/35 |
| 3,406,971 | 4/1965 | Koff . | |
| 3,485,494 | 2/1967 | Lieberman . | |
| 3,561,757 | 3/1969 | Schillig . | |
| 4,154,440 | 6/1977 | Rusk . | |
| 4,337,941 | 7/1982 | Kitka | 482/35 |
| 4,497,279 | 2/1985 | Bell . | |
| 4,824,098 | 4/1989 | Huang . | |
| 4,953,502 | 9/1990 | Hoover | 119/29 |

FOREIGN PATENT DOCUMENTS

| | | | |
|---|---|---|---|
| 0247054 | 2/1926 | Fed. Rep. of Germany | 482/35 |
| 587951 | 1/1978 | U.S.S.R. . | |
| 9009814 | 9/1990 | World Int. Prop. O. | 482/35 |

OTHER PUBLICATIONS

"Gym Dandy"—Playthings, vol. 62 #1 p. 17 Jan. 1964.

*Primary Examiner*—Stephen R. Crow

*Attorney, Agent, or Firm*—Hill, Steadman & Simpson

[57] ABSTRACT

Playground devices in the form of building constructions are provided to relax, entertain, exercise and teach children while always maintaining them in full view and within easy access from the outside to their parents or attendants. The structures are divided into rooms or cubicles interconnected to form a variety of maze passages on a plurality of levels permitting the children to selectively and sequentially advance from an entrance to an exit or return to the entrance. The devices may include dining rooms, play rooms, exercise zones and the like, interconnected in such a way that the child has many ways to use the devices.

14 Claims, 7 Drawing Sheets

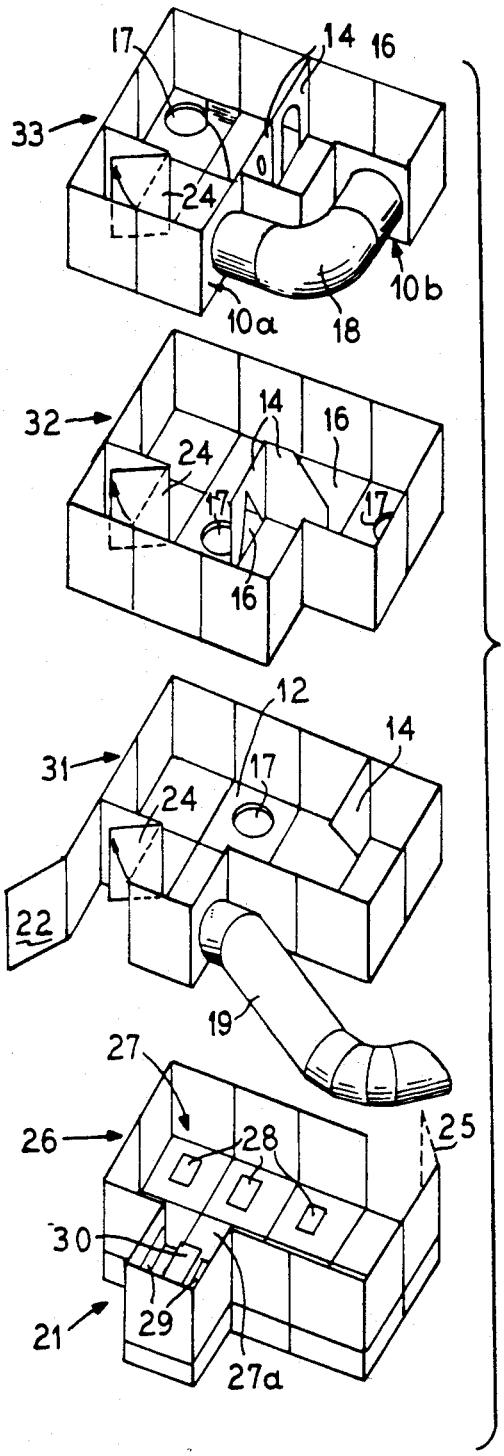
FIG. 2
FIG. 4
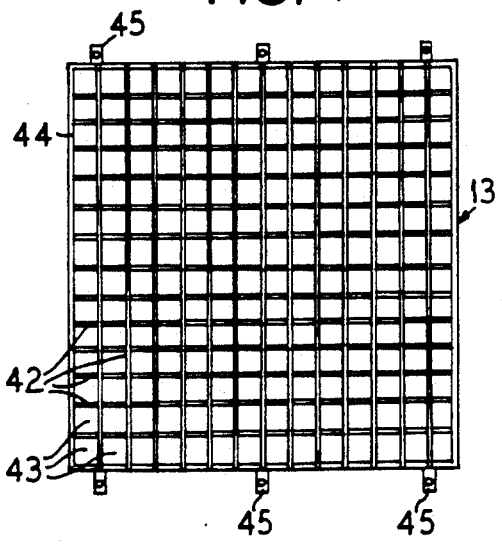
FIG. 5
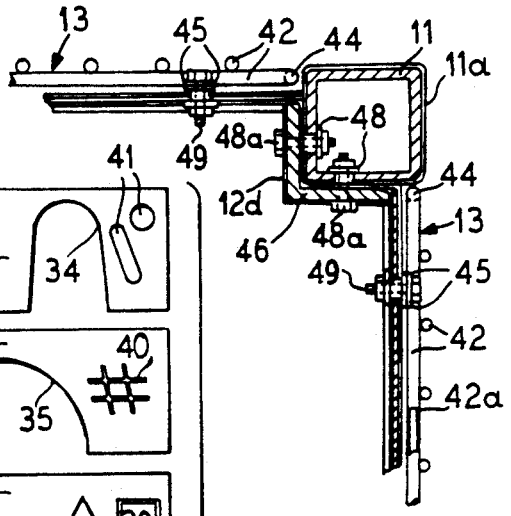
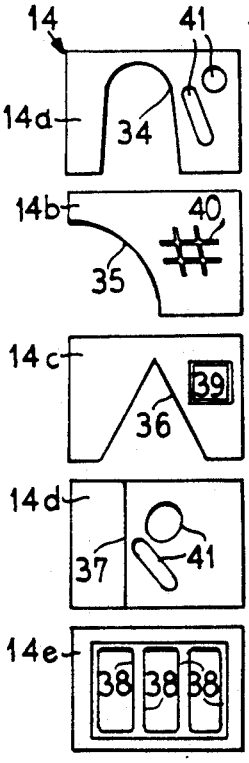
FIG. 3

PLAYGROUND MAZE APPARATUS

BACKGROUND OF THE INVENTION

Field of the Invention

This invention relates to the art of playground apparatus or devices and particularly relates to building constructions with generally enclosed but fully accessible and visible areas having a plurality of cubicles or compartments interconnected to provide enclosed multi-passage non-directional mazes between entrances and exits to selectively or sequentially picnic, rest, play, exercise, and teach children under full view of their parents or attendants outside the building. The invention particularly deals with multi-level playground houses having a plurality of vertical columns, horizontal decks and vertical dividers arranged to enclose children in full view and quickly accessible and providing a wide range of usages for the children.

Heretofore known maze-type playground structures blocked outside viewing of the children passing therethrough and prevented access to the children from the outside in the event they became confused or frightened as they advanced through the maze. These devices generally had module blocks attached together as to form crawl-through single passages and did not provide play areas, party rooms, picnic areas and the like.

It would therefore be an improvement in this art to provide maze-type playground apparatus having cubicles or rooms which are completely visible and accessible from the outside.

A further improvement in this art is to provide maze-type playground constructions having entertainment and quiet rooms, play areas, rooms equipped with tables and benches for dining and room having toys, games and the like.

A feature of the invention is the provision of quick emergency access to all compartments of a maze-type playground device.

Another feature of the invention is the provision of multi-level playground constructions with interconnected rooms at each level between a lower inlet and an upper outlet which can discharge to ground level through a chute.

A further feature of the invention is to provide multi-level maze structures with access openings between levels which protect the children against falling.

A still further feature of the invention is the provision of basic playground structures which can be finalized into various maze defining chambers and passages.

Other and further objects and features of this invention will become apparent to those skilled in this art from the following detailed descriptions of the annexed sheets of drawings illustrating preferred embodiments of the invention.

ON THE DRAWINGS

FIG. 2 is a somewhat diagrammatic exploded perspective view of the four levels of the device of FIG. 1 and illustrating various arrangements for interior dividers on the various levels.

FIG. 3 is an elevational view of various types of dividers useful in the device of FIG. 1.

FIG. 4 is an elevational view of mesh-type external panels closing the device of FIG. 1 but maintaining all of its interior in full view from the outside.

FIG. 5 is a horizontal sectional view along the line V—V of FIG. 1 illustrating the manner in which decks and panels of the device are mounted on upright frame posts or columns.

AS SHOWN ON THE DRAWINGS

Figure 1:
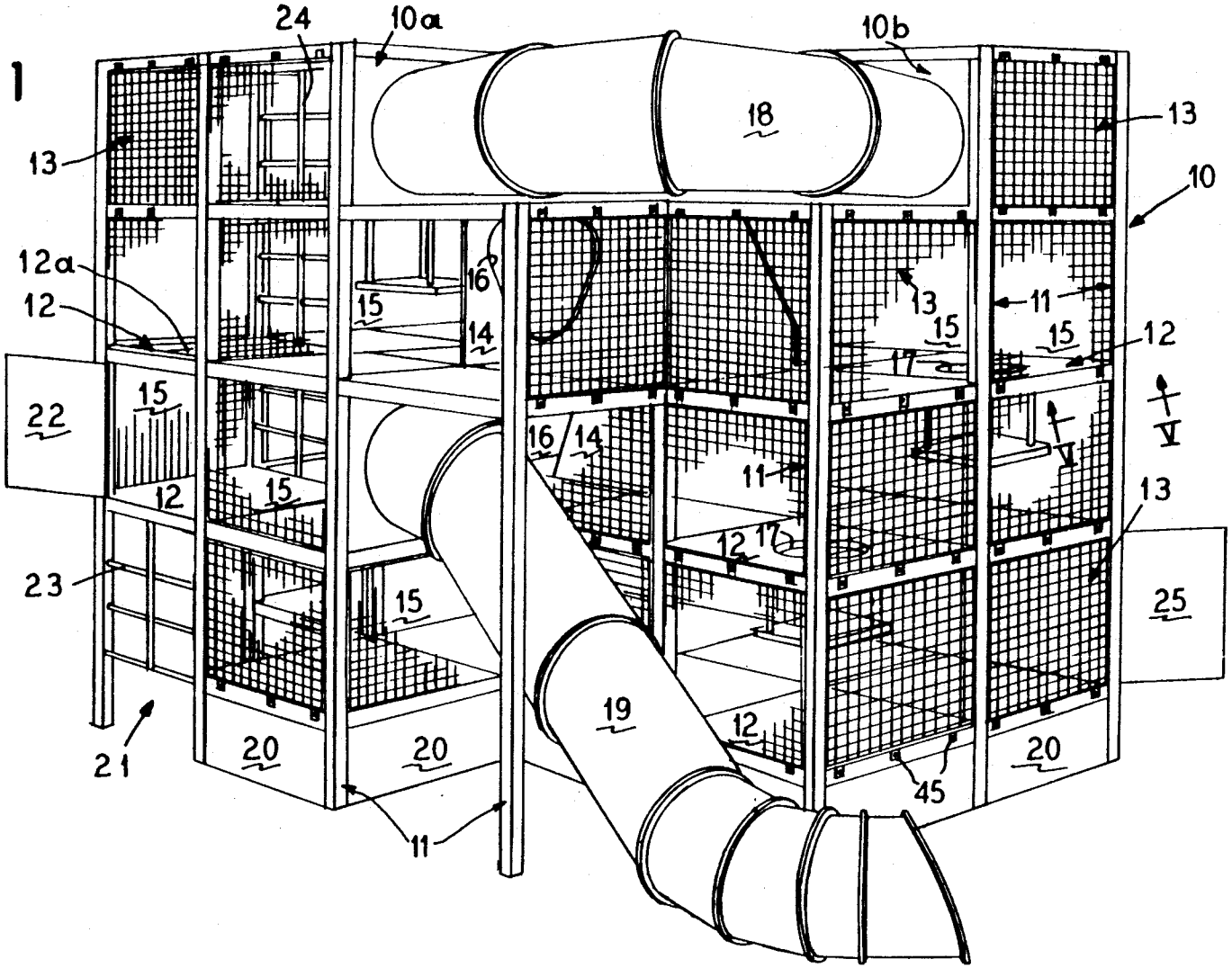
FIG. 1 is an outside perspective view of a multi-level maze-type playground device according to this invention.

In FIG. 1, the reference numeral 10 designates generally a four level, generally rectangular playground device of this invention. The device 10 has spaced upright square tubular columns or posts 11 preferably spaced apart about 300–800 mm and supporting square or rectangular horizontal decks 12 spaced vertically about 700–1400 mm. The decks 12 provide floors and ceilings for the device.

Vertical open mesh panels 13 between the posts mounted on the decks 12 span the spaces between the floors and ceilings around the periphery of the device to enclose the entire device without obstructing a full view of the exterior. Dividers 14 inside the periphery form cubicles or rooms 15. Openings 16 in the dividers 14 selectively connect the rooms 15 on the each level and openings 17 in some of the decks 12 connect rooms or cubicles on different levels.

As illustrated in FIG. 1, the generally rectangular device 10 has a notched-out open corner section dividing the structure into two legs 10*a* and 10*b* connected at the top level by a tube 18 providing a tunnel-like passageway between rooms or cubicles in the two legs. A cute tube 19 provides an exit from the second level to ground level.

The bottom floor decks of the first level are positioned about 500 mm above ground providing a convenient height for a small child to climb into the structure. The gap between the bottom decks and the ground is covered with closed sheet metal panels 20.

One corner of the device 10 is arranged to provide quick access to all of the rooms or compartments 15 of the device to easily reach and retrieve children from any area of the device. Thus, as shown in FIG. 1, an open corner 21 of the device is covered by a deck 12 forming the floor of a second level room 15 above this corner. A door 22 gives outside access to this room which is easily reached by a ladder 23. The ceiling deck for this room has a large opening 12*a* giving access to the third level corner room and a similar opening is provided in the deck between the third and fourth level rooms. A ladder 24 on the back walls of the rooms above the corner 21 is also provided. Doors 25 (FIG. 2) provide access to the rooms adjacent the corner 21. An attendant can quickly climb to the second level, stand on the second level deck 12 and reach through openings 12*a* in the third and fourth level decks 12 to open the doors 24 to the adjacent rooms 15 permitting easy access into the various compartments on all levels to rescue a child. The attendant can climb into these compartments if necessary.

A door 25 opposite the corner 21 controls entrance to the apparatus 10 to provide security when the device is not in use.

FIG. 2 demonstrates available interior arrangements for the device 10 at the different levels. Thus as shown, the first level 26 provides a large playroom 27 entered from the door 25 which can be equipped with various playground toys such as teeter-totters, fixed spring devices, automobiles and the like 28. Then the nook or extending zone 27*a* of the room 27 can be equipped with benches 29 and a table 30 for dining.

The second level 31 can be reached through a hole or opening 17 in a deck 12 and this level can be divided into various compartments or smaller cubicles by means of the divider walls such as 14 arranged to provide maze passages, some of which communicate with the third level 32 through the same types of openings 17. Then the fourth or top level 33 containing the tunnel 18 can be reached through one or more openings 17 in the third level ceiling decks 12. The various openings 16 in the room dividers 14 provide various maze passageways between the rooms 15 on each floor level.

As shown in FIG. 3, the room dividers 14 can have many different types of openings. Thus, the divider 14*a* has an open bottom U-shaped passage 34 therethrough, the divider 14*b* has an arcuate corner opening 35, the divider 14*c* has a triangular opening 36, the divider 14*d* has a rectangular open half 37 and the divider 14*e* has resilient vertical squeeze bars 38 permitting a child to push its way through the divider.

The dividers can also be provided with games or the like for entertaining the children, such as the blackboard 39 of 14*c*, the tic-tac-toe game 40 of divider 14*b*, and peek holes 41 of the dividers 14*a* and 14*d*.

As shown in FIGS. 4 and 5, the mesh panels 13 are composed of welded together horizontal and vertical rods 42 providing square openings 43 therebetween which are large enough to prevent a child's fingers from being caught and small enough to prevent the passage of a child's hand or arm. The panels are surrounded by an encompassing frame bar 44 and the top and bottom sides of this frame bar 44 carry projecting lugs 45 with bolt holes therethrough.

Figure 6:
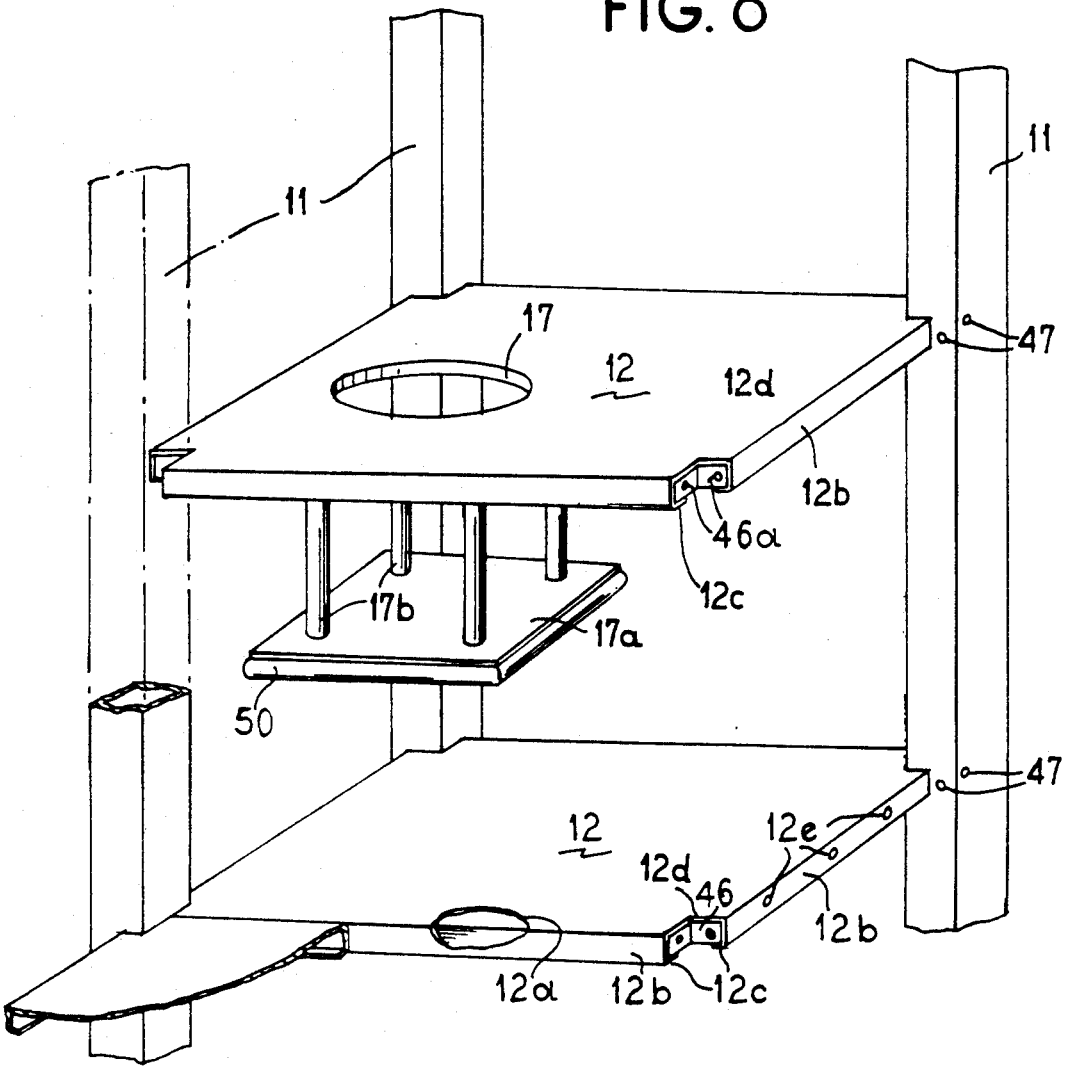
FIG. 6 is a fragmentary broken perspective view of a portion of the device of FIG. 1 illustrating construction of the decks and a safety device for an access opening between levels.

As shown in FIGS. 5 and 6, the upright posts or columns 11 are coated with plastic 11*a* as are the decks illustrated at 12*a* and the rods illustrated at 42*a*.

The decks 12 have dependent peripheral skirts 12*b* with inturned lips 12*c*. Notches 12*d* are cut out of the corners of the decks and angle brackets 46 are welded into these notches fitting against the insides of the skirts 12*b* and between the deck tops and lips 12*c*. The posts or columns 11 have holes 47 with internal nut type fasteners 48 behind these holes at levels to receive the decks 12. Bolt type fasteners 48*a* pass through these holes 47 and through holes 46*a* in the angle brackets 46 to securely anchor the decks to the columns or posts. The nut fasteners 48 are fixedly mounted inside the posts during fabrication of the posts and provide for an easy reception and removal of the bolt fasteners 48*a* thus accommodating easy assembly and disassembly of the decks and posts.

The tabs 45 of adjacent superimposed mesh panels 13 are overlapped and fasteners 49 are passed through the overlapped tabs and apertures 12*e* of the deck skirts 12*b* to secure the panels to the decks as illustrated in FIG. 5.

The device 10 can thus be easily put together and dismantled for erection at another location.

Figure 7:
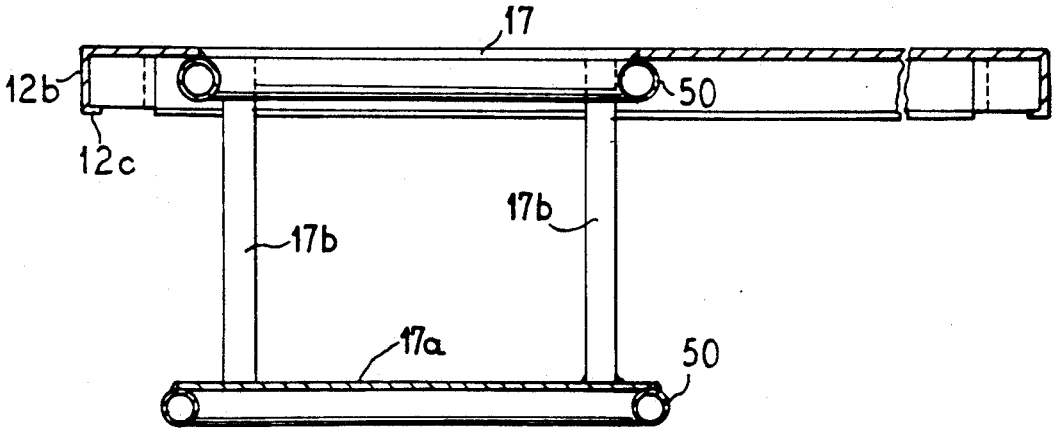
FIG. 7 is a transverse sectional view along the line VII—VII of FIG. 6.

The climb-through apertures 17 in the decks 12, as illustrated in FIGS. 6 and 7 have horizontal platforms 17*a* suspended from straps or posts 17*b* at levels about half way between the floor and ceiling decks 12. These platforms 17*a* are plates at levels so that a child can easily climb to and from them from a floor deck 12 through the opening 17 in the ceiling deck. Plastic covered metal tubes 50 surround the under peripheral face of the platform 17*a* and the opening 17 to rigidify the platform and opening and to prevent cuts from sharp edges.

The device 10 of FIGS. 1–7 may be equipped with any desired type of top roof including deck panels 12 as illustrated, flat or contoured impervious roof structures, plastic bubble dome-type covers and the like.

From the above descriptions of FIGS. 1–7, it will be understood that this embodiment 10 is a multi-level or multi-story playhouse or playground structure having cubicles or rooms serving different purposes at different levels and connected through openings in deck and wall panels enabling a child to walk or crawl through the entire structure or any part of it to seek chosen passive areas, play areas and maze passages between an entrance and an exit without ever being blocked from the outside view of the parent or other attendant and that the child may select various passive or action zones as he may desire.

Figure 8:
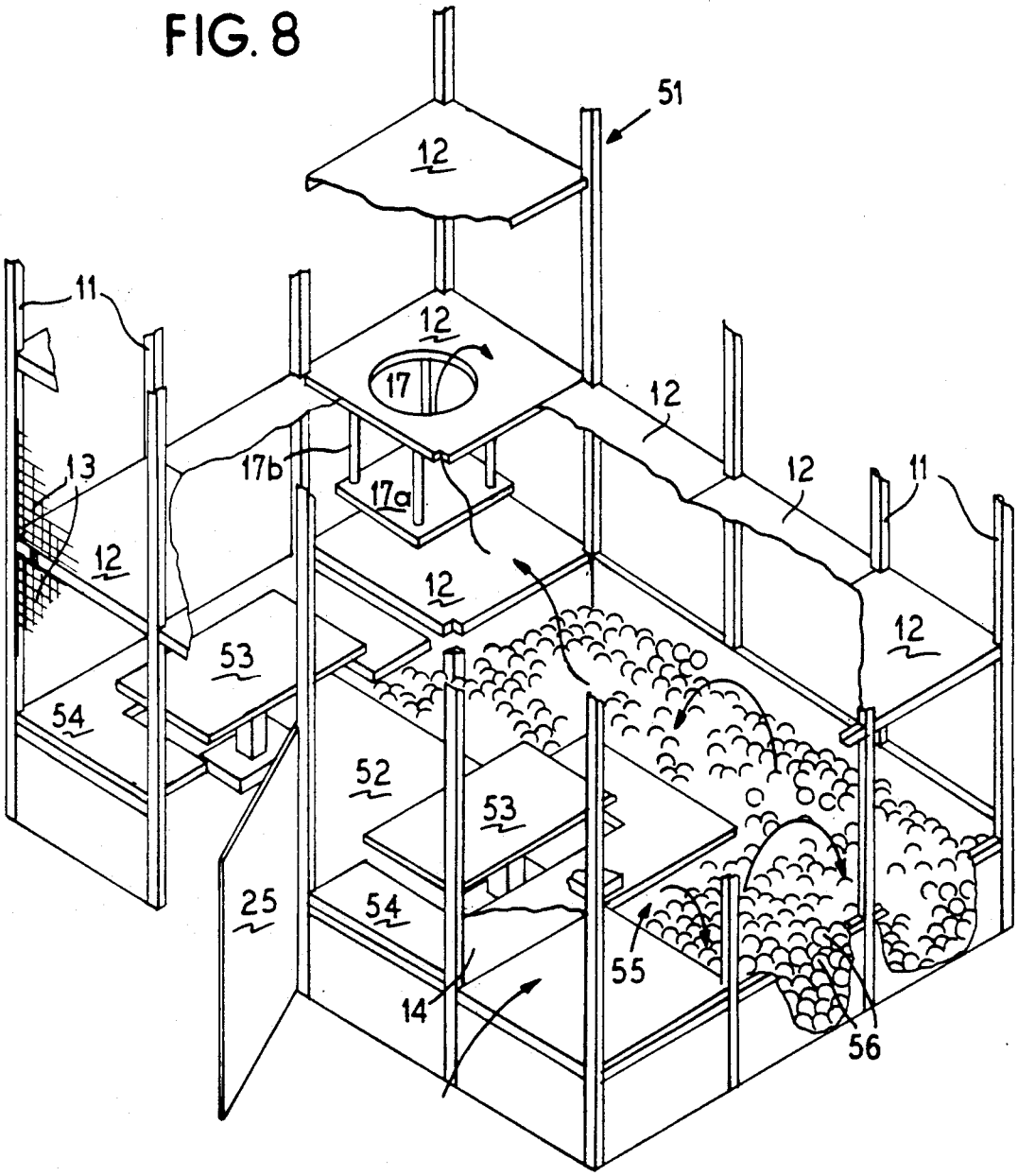
FIG. 8 is a fragmentary and broken away perspective view of another embodiment of the playground device of this invention.

A modification or second embodiment of the invention is illustrated in FIG. 8 where the device 51 has the same type of upright columns or posts 11, decks 12, climb through openings 17 with underlying platforms 17*a*, entrance door 25 and the like. However, in the device 51, the entrance door 25 gives access to a dining room 52 with tables 53 and benches 54 accommodating a large number of children as a dining room, picnic or party room. This room 52 is backed by a pit 55 filled with plastic bouncing balls 56, a tarpaulin and the like. This pit area then has access to several levels of decks 12. A child exiting the pit area can enter the room areas or cubicles 15 provided by the decks 12 and divider walls 14.

The device 51 is enclosed by screened panels 13 like the device 10.

Figure 9:
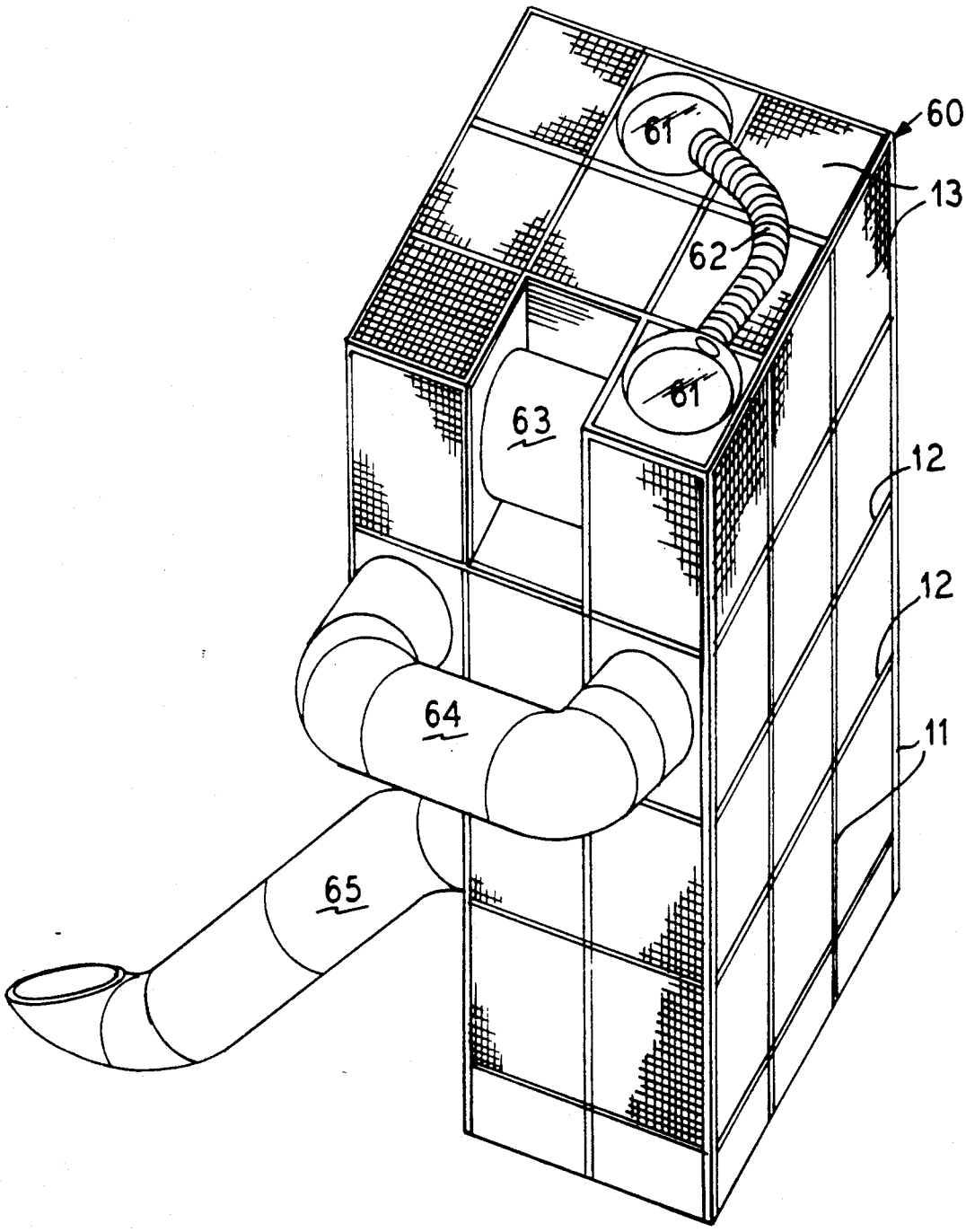
FIG. 9 is a perspective view similar to FIG. 1, but illustrating another embodiment of the invention.

Another embodiment 60 of the invention is illustrated in FIG. 9 wherein the columns or posts 11 and the decks 12 are enclosed by screen panels 13 as in the device 10 of FIG. 1 and rooms or cubicles are also provided on a plurality of levels. Roof panels 13 have several plastic bubble domes 61 connected by a tube 62 providing a voice transmission connection between the bubble zones. Crawl tunnels 63 and 64 connect different cubicles or rooms and an exit chute 65 from an upper level transports the children to the ground level. The compartments of cubicles in the various levels can be separated as desired by dividers to provide many types of maze passages.

Figure 10:
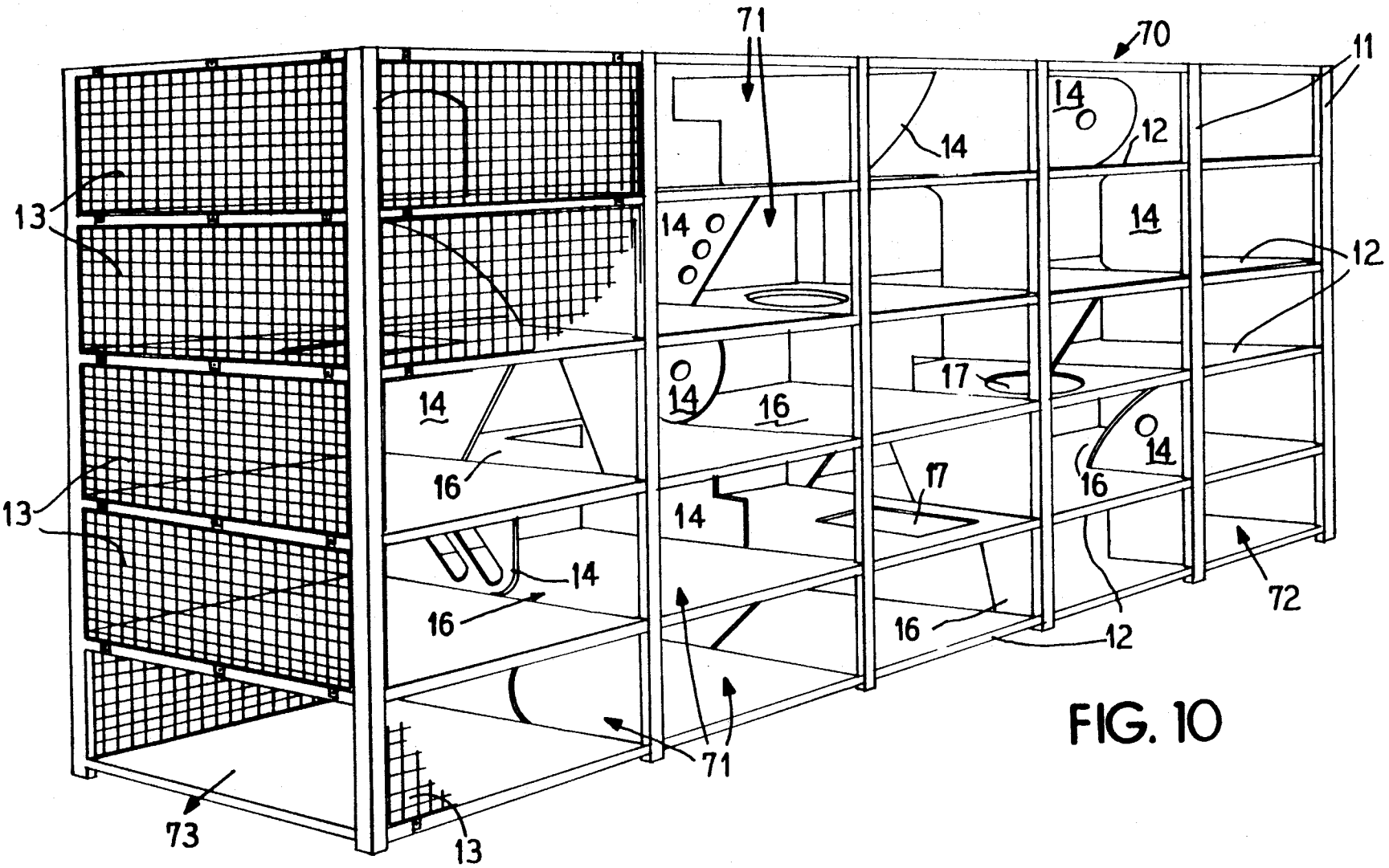
FIG. 10 is a perspective view of still another embodiment of the invention which can be placed against a wall of a building or used as a room divider inside the building.

Another modification or embodiment is shown in FIG. 10 where a rectangular device 70 has a single row of compartments or rooms 71 on each level with the mesh panels 13 embracing the entire rectangular device or only its front and one end wall. This type of device is useful as a room divider wall for mounting in a building or the like or for placing against a building side and end wall as illustrated. In both types of usages, the child is always fully visible and accessible.

As specifically shown in FIG. 10, the child can enter a front opening as illustrated at 72 and selected a number of passages 17 through decks 12 and through passages 16 of the dividers 14. The child can exit an openings through an end room as illustrated at 73.

Figure 11:
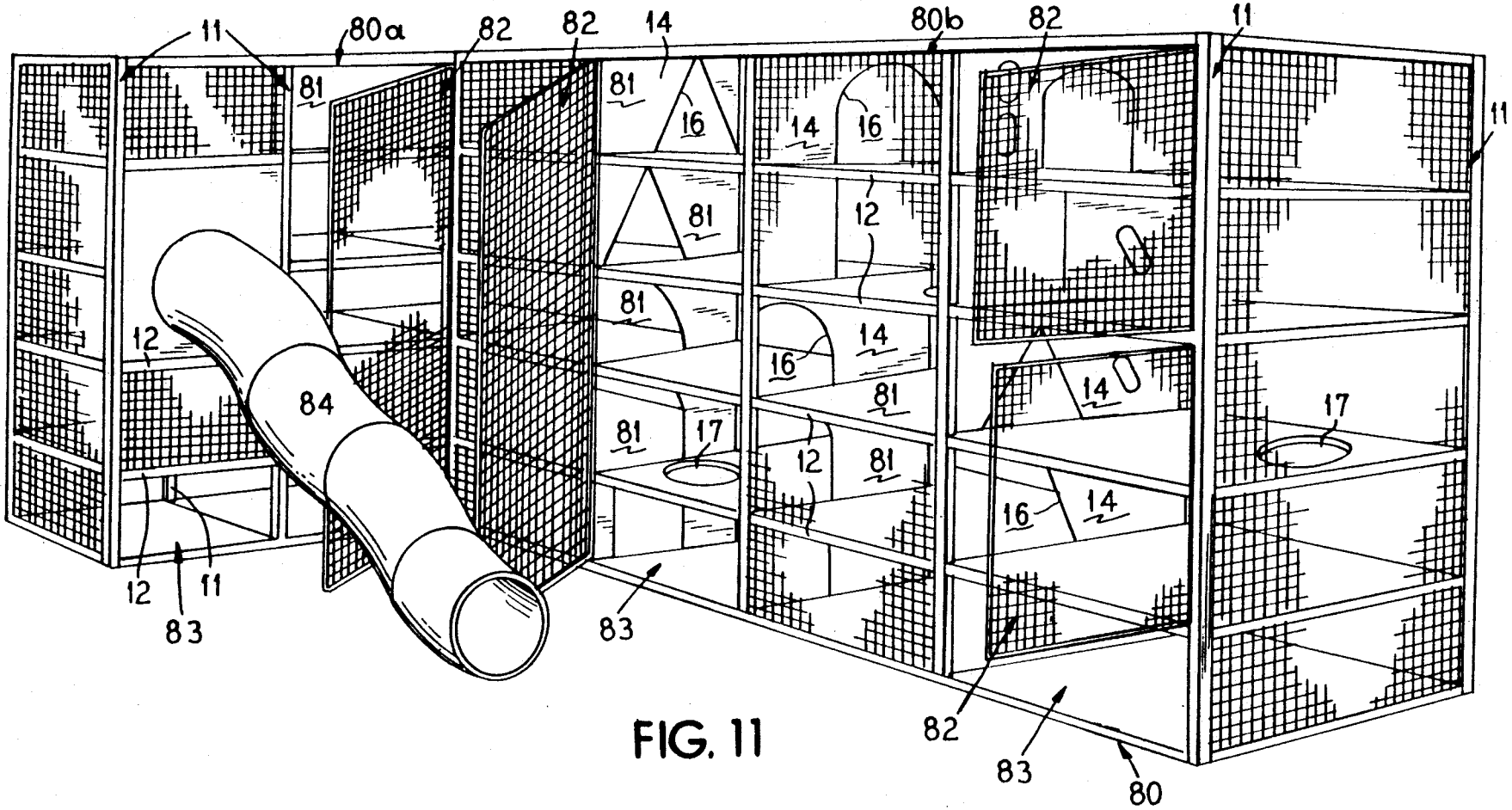
FIG. 11 is a perspective view of still another embodiment of the invention, which, like embodiment shown in FIG. 10 can be placed against a wall of a building of used as a room divider inside the building.

Still another embodiment of the invention is shown in FIG. 11 where an L-shaped device 80 can be set up as a room divider or against a side and end wall of a building. When the device is to be used as a room divider the cubicals are backed with mesh but when the used up against a wall or corner wall, the mesh can be eliminated with the device fitting tightly against the walls. In the FIG. 11 embodiment as in the FIG. 10 embodiment, rows of compartments or rooms 81 are provided on each of a plurality of levels which as illustrated include five levels. Two to seven levels are practical. The rooms 81 are about 1 meter high and rectangular in shape. Each level as illustrated has a single row of rooms 81 so that it is fully visible from the outside even when mounted against a building wall.

In the embodiments 80 the same types of posts or columns 1, decks 12, room dividers 14, access openings 16 for the room dividers 14, and 17 in the decks 12 connected the various levels.

The L-shaped device 80 ha a first shorter leg 80*a* at right angles to a longer leg 80*b* each of which can be of any desired length or width.

Doors such as 82 give access to the rooms or cubicals on all levels and can extend the full height of the device or be provided in two sections. These doors give quick access to the children in the device and provide for easy maintenance cleaning of the device.

The child can enter and leave the device at any one or more entrances 83 or exits at the bottom level. A chute 84 is provided at an upper level room or cubical providing quick exiting as illustrated in embodiment 10.

It will be understood that devices such as shown in FIGS. 10 and 11 can be used in multiple and can be connected through tubes such as 18 in FIG. 1.

From the illustrations and descriptions of FIGS. 8–11, it will be understood that the basic construction of the FIG. 1–7 embodiment can be rearranged and modified as desired to provide many different play houses and mazes.

I claim as my invention:

1. Playground apparatus which comprises a plurality of upstanding longitudinally and transversely spaced posts, vertically spaced horizontal decks supported by said posts, vertical dividers between said decks providing a plurality of cubicles, vertical open mesh panels enclosing the outer peripheries of the cubicles, passages through the decks and dividers connecting the cubicles in maze paths, means providing outside access to the cubicles, plastic roof domes on the top of the apparatus, and a voice tube connecting the domes.

2. Playground apparatus which comprises a plurality of upstanding longitudinally and transversely spaced posts, vertically spaced horizontal decks having outer perimeters supported by said posts and providing therebetween a plurality of superimposed rooms, said decks having openings therethrough connecting the superimposed rooms, vertical dividers secured to the decks separating the rooms into a plurality of open periphery compartments on each level of the superimposed rooms, said dividers having openings therethrough positioned to connect adjacent compartments without blocking the open peripheries of the compartments and forming multidirection maze paths communicating with said openings in the decks to permit occupants to follow the maze paths in reversible directions to enter and leave the cubicles, upright open mesh panels secured to said outer perimeters of the decks enclosing the outer peripheries of the cubicles, the mesh of said panels retaining occupants in the cubicles and adapted to be grasped by the occupants while providing full view of the occupants from the outside of the apparatus, means mounting some of the panels for manual access to each cubicle, means providing an entrance to a bottom level cubicle, means providing an exit from at least one cubicle, and a roof supported by said posts overlying said apparatus.

3. A playhouse which comprises a plurality of upstanding longitudinally and transversely spaced posts, vertically spaced horizontal decks supported by said posts and cooperating therewith to define floors and ceilings of a multi-story house, vertical dividers between said decks dividing each story of the multi-house into a plurality of cubicles, some of said decks having openings connecting cubicles of the multi-story house, platforms supported from the decks aligned below said openings providing access to the openings and blocking falls through the openings to a lower level deck, upright panels supported by said posts around said house enclosing the outer peripheries of the cubicles while providing visual access to each cubicle, play devices mounted in some of said cubicles, means providing rest areas in some of said cubicles, table and seat means in at least one of said cubicles, exercise means in at least one of said cubicles, means defining an open entrance to a lower level of said multi-level house, means defining an exit from an upper level of said house, means carried by said posts swingably supporting at least one panel at each level of the house to provide access to the cubicles, and roof means supported by said posts covering the top of said house.

4. The playground apparatus of claim 1 wherein the decks are removably mounted on the posts and the panels are removably mounted on the decks.

5. The apparatus of claim 1 including an exterior tunnel connecting a pair of cubicles supported by said panels.

6. The apparatus of claim 2 including transparent domes on said roof providing visibility to surrounding areas of the apparatus.

7. The apparatus of claim 2 including a cute carried by an upper level panel and discharging at ground level.

8. The playground apparatus of claim 2 wherein the posts are positioned to provide an L-shaped apparatus adapted to be positioned in the building to provide a room divider or placed against intersecting walls of the building.

9. The apparatus of claim 2 having a tunnel mounted on spaced panels connecting the outer peripheries of the cubicle defined by said panels.

10. The apparatus of claim 7 wherein the chute is supported from an upper level panel.

11. The playhouse of claim 3 including transparent domes on said roof means at levels adapted to receive the head of a child in a top cubicle.

12. The playhouse of claim 3 including voice transmission means connecting some of the cubicles.

13. The playhouse of claim 3 wherein said exit is a chute discharging at ground level.

14. The playhouse of claim 3 including a door closing said entrance, and locking means for said door preventing unauthorized access to said playhouse.

* * * * *